US005486128A

United States Patent [19]

Tsuchiya et al.

[11] Patent Number: 5,486,128

[45] Date of Patent: Jan. 23, 1996

[54] POWDER BEAM ETCHING MACHINE

[75] Inventors: Takashi Tsuchiya, Tokyo; Osamu Ishii, Kanagawa, both of Japan

[73] Assignee: Sony Corporation, Tokyo, Japan

[21] Appl. No.: 137,516

[22] Filed: Oct. 18, 1993

[30] Foreign Application Priority Data

Oct. 30, 1992 [JP] Japan ..... 4-316582

[51] Int. Cl.[6] ..... B24C 3/00

[52] U.S. Cl. ..... 451/2; 451/38; 451/80

[58] Field of Search ..... 451/38, 39, 40, 451/75, 78, 80, 89, 65, 2; 269/15, 289 R, 302.1

[56] References Cited

U.S. PATENT DOCUMENTS 888,294 5/1908 Affleck ..... 269/15

3,754,812 8/1973 Mohn ..... 350/167

5,271,188 12/1993 Yoshikawa ..... 451/80

5,366,208 11/1994 Benjamin ..... 269/13

*Primary Examiner*—Bruce M. Kisliuk

*Assistant Examiner*—Derris Banks

*Attorney, Agent, or Firm*—Ronald P. Kananen

[57] ABSTRACT

In a powder beam etching machine, slopes are formed in upper and lower edge surfaces of a rib formed along an outer margin of a platen and through-holes are formed around four corners. With such an arrangement, the powders adhered work may readily be removed by injection of air during a cleaning operation.

3 Claims, 4 Drawing Sheets

POWDER BEAM ETCHING MACHINE

BACKGROUND OF THE INVENTION

1. Field of the Invention

The present invention relates to a powder beam etching machine having a cleaning chamber for cleaning a workpiece (hereinafter referred to as a work) which has been etched, by jetting air to the work.

2. Description of the Related Art

In a conventional powder beam etching machine, a support member (hereinafter referred to as a platen) which is used for supporting a work for etching and cleaning has side surfaces substantially perpendicular to a support surface.

However, in case of using such a platen, when air is jetted in a direction perpendicular to the support surface of the platen for cleaning, the side surfaces thereof are in parallel to the air flow. Accordingly, the air pressure is not applied to the side surfaces. It takes a long time to inject the air to remove powders adhered or stuck to the side surfaces. Also, in the case where recesses are formed in a lower surface of the platen or brackets for supporting pins for delivery of the platen are formed to project from the lower surface thereof, a stagnation of powders would occur in top and bottom surfaces and corner portions of the platen. Also, the powders adhered to the corner portions could not be removed away only by the air injection. In order to apply the air pressure to each surface of the platen, it is necessary to provide at least six air injection outlet ports.

In view of the above-noted defects, an object of the present invention is to provide a powder beam etching machine which is capable of readily removing all powders adhered to the platen after the working of the work.

SUMMARY OF THE INVENTION

According to the present invention, there is provided a powder beam etching machine comprising: an injection chamber for etching a work laid on a support member by injecting powders to the work; a cleaning chamber for cleaning the work which has been etched, by injecting air toward the support member in a direction substantially perpendicular to the support member; wherein the air is directed toward the at least one slope side at an acute angle.

Since the slopes are formed in the surface of the platen at an acute angle relative to the flow of air injected to the side surfaces and the like of the platen, the air pressure is applied to the slopes to remove the powders adhered to the side surfaces with ease.

According to the invention, through-holes are formed around four corners of said support member. Since the through-holes are formed around the corners of the platen where the stagnation of the powder is likely to occur, it is possible to remove the powders adhered therearound with ease.

According to another aspect of the invention, the slopes are in the range of 20° to 70° relative to the surface of the support member.

BRIEF DESCRIPTION OF THE DRAWINGS

In the accompanying drawings:

FIG. 6 is a side elevational view showing the arrangement shown in FIG. 5, in which:

DESCRIPTION OF THE PREFERRED EMBODIMENTS

A powder beam etching device according to one embodiment of the invention will now be described with reference to the accompanying drawings.

Figure 1:
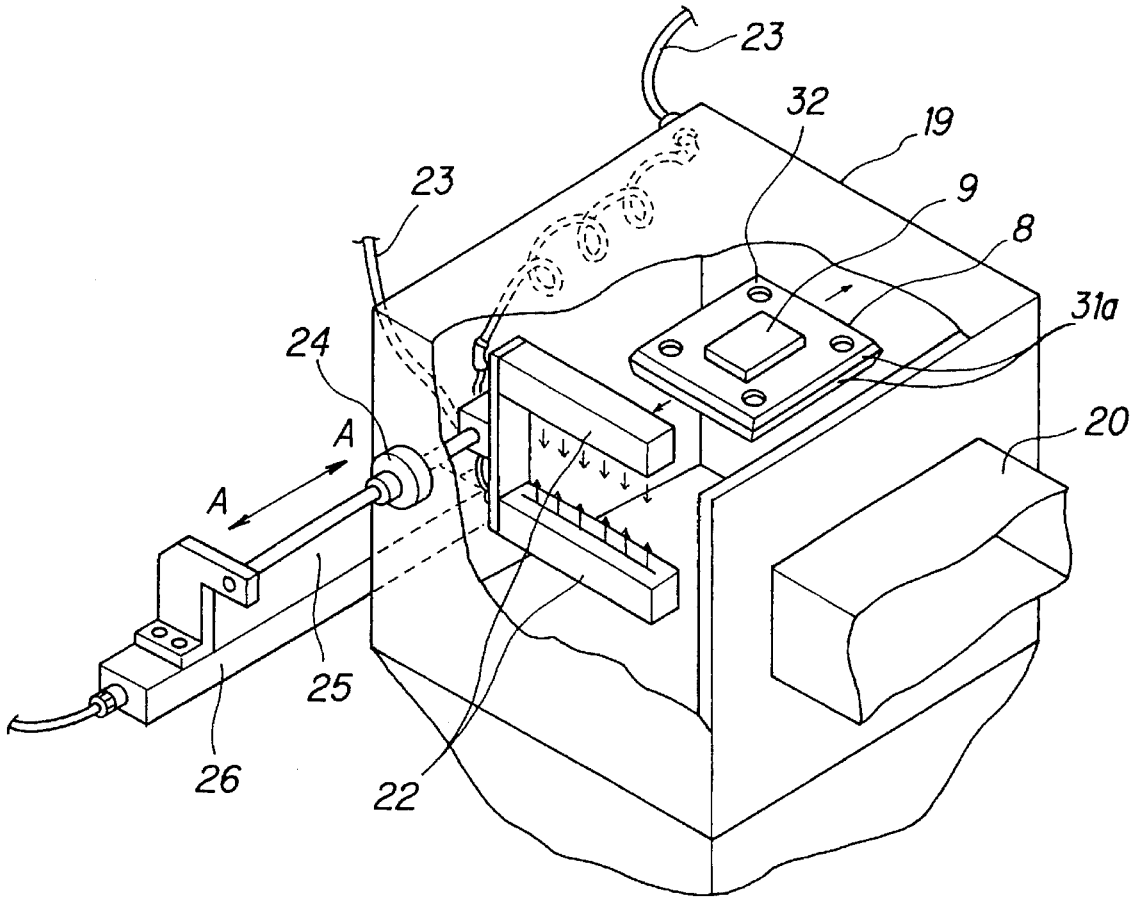
FIG. 1 is a partially fragmentary, perspective view showing an arrangement of a cleaning chamber in a powder beam etching machine according to an embodiment of the invention.
Figure 2:
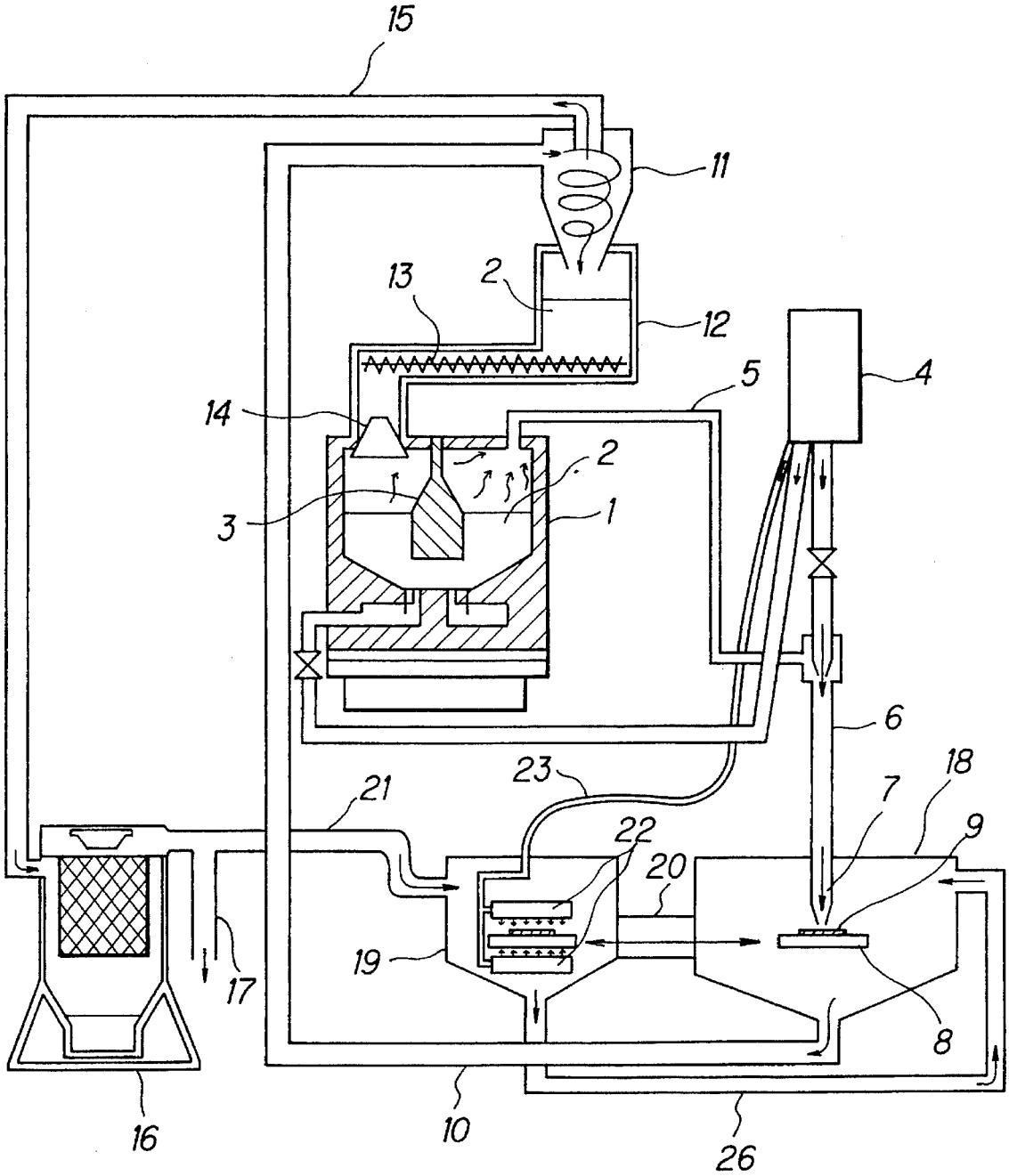
FIG. 2 is a schematic view showing an overall arrangement of the powder beam etching machine according to the embodiment of the present invention.

FIGS. 1 to 4 show an arrangement according to the embodiment of the invention. In FIG. 2, fine powders 2 contained in a mixing tank 1 are agitated by an agitating member 3, and is fed into a discharge conduit 6 through a piping 5 by air fed from a dry air source 4. The air is compressed and fed from the dry air source 4. The powders 2 which has been fed into the discharge conduit 6 are delivered by the air. The powders 2 are jetted from an injection nozzle 7, provided at a tip end of the discharge conduit 6, onto a work 9 laid on a platen 8, thus carrying out etching.

The powders 2 after the etching are fed to a cyclone 11 through a return conduit 10 and is collected into a powder supply portion 12. The powders 2 contained in the powder supply portion 12 are fed toward the mixing tank 1 by a screw 13 and is fed into the mixing tank 1 by opening a supply valve 14. The cyclone 11 is connected to an air discharge blower 16 through a discharge conduit 15. A discharge duct 17 is provided to the air discharge blower 16.

On the other hand, a cleaning chamber 19 is connected through a duct 20 to an injection chamber 18 for carrying out the etching of the work 9 disposed on the platen 8. The cleaning chamber 19 is connected to the air discharge blower 16 through a piping 21. As best shown in FIG. 1, a pair of upper and lower air blowers 22 are provided within the cleaning chamber 19. The air is supplied from the dry air source 4 through an air supply conduit 23 to the blowers 22. A drive rod 25 is provided movably in a direction indicated by a two-headed arrow A—A through a linear bush 24. The drive rod 25 is driven by a rodless cylinder 26. The air blowers 22 are fixed to a tip end of the drive rod 25 so that the air blowers 22 may be reciprocatingly driven in the direction A—A by the rodless cylinder 26.

A duct 20 for connecting the injection chamber 18 and the cleaning chamber 19 to each other extends perpendicular to the direction of the drive rod 25. The platen 8 may be moved between both the chambers 18 and 19 by a delivery device (not shown). After the etching has been carried out in the injection chamber 18, the work 9 is moved into the cleaning chamber 19 together with the platen 8 and fed into between the pair of upper and lower air blowers 22. The air is injected or jetted from the air blowers 22 to the work to thereby remove the powders away from the work 9 and the platen 8. The air injected from the air blowers 22 is fed into the injection chamber 18 through the return conduit 26.

Figure 3:
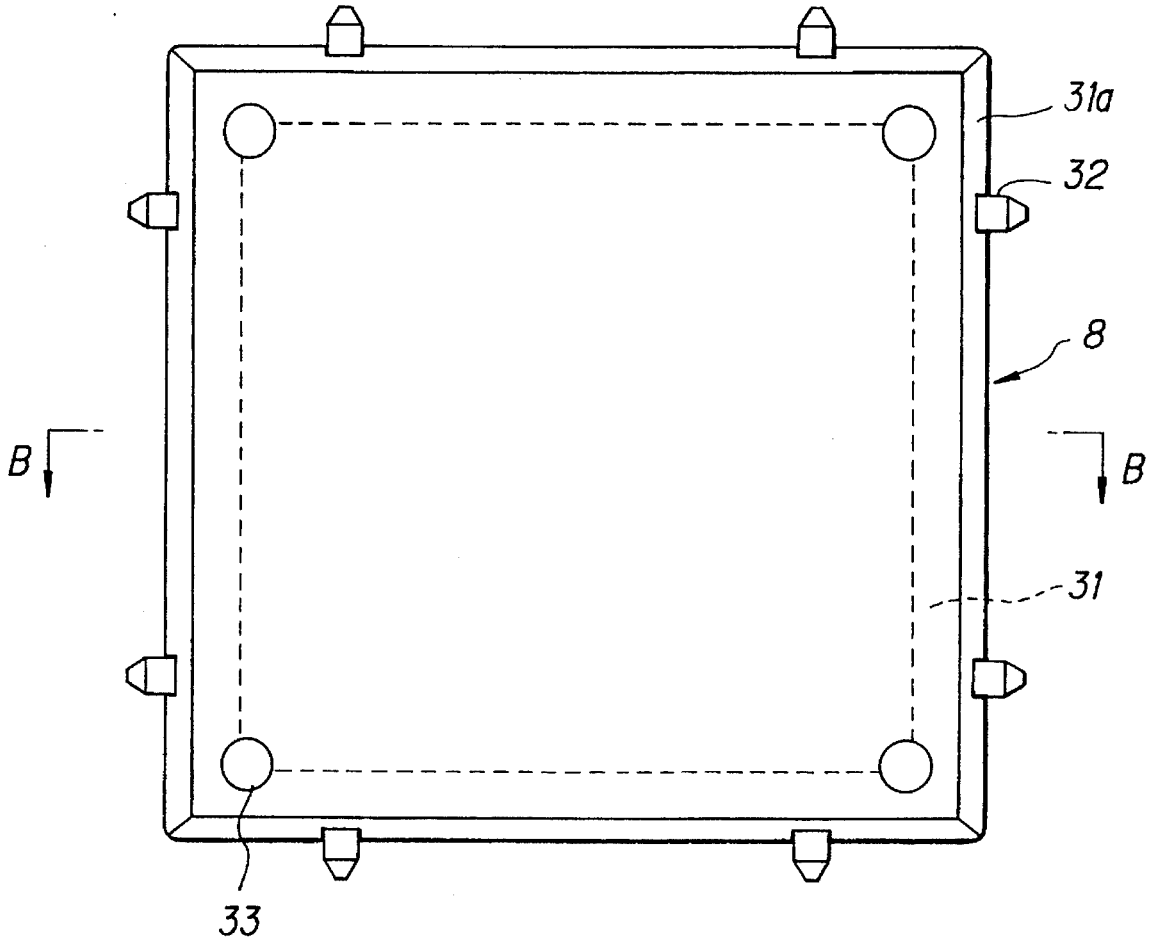
FIG. 3 is a plan view showing an example of the arrangement of a platen shown in FIG. 1.
Figure 4:
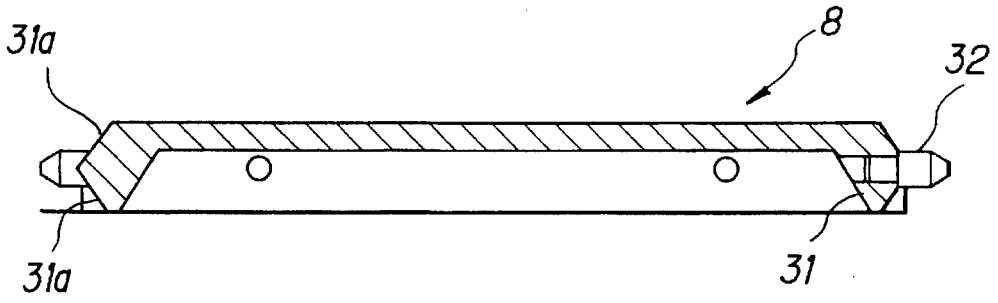
FIG. 4 is a cross-sectional view taken along the line B—B of FIG. 3.

As shown in FIGS. 3 and 4, the platen 8 is composed of a substantially squared plate and is provided with a rib which extends downwardly. Two pins 32 for retaining hooks during the delivery of the platen 8 are implanted in each side of the platen 8. Slopes 31*a* having a slant angle of 20° to 70° with respect to the top surface of the platen 8 are formed on upper and lower edges of the rib 31 so that the upper and lower surfaces are largely bevelled. Four through-holes 33 are formed in the four corners of the platen 8, respectively.

According to the foregoing embodiment, when the air is injected from the air blowers 22 perpendicular to the upper and lower surfaces of the platen 8 on which the work 9 is disposed, the air is applied to the slopes 31*a* of the rib 31 of the platen 8. Accordingly, the powders 2 adhered to those slopes may readily be removed away. Also, the powders 2 which have adhered to the four inner corners of the rib 31 may readily be removed because the air passes through the through-holes 33. Accordingly, by reciprocating the air blowers 22 relative to the platen 8 once, it is possible to easily remove all powders 22 adhered to the platen 8.

Figure 5:
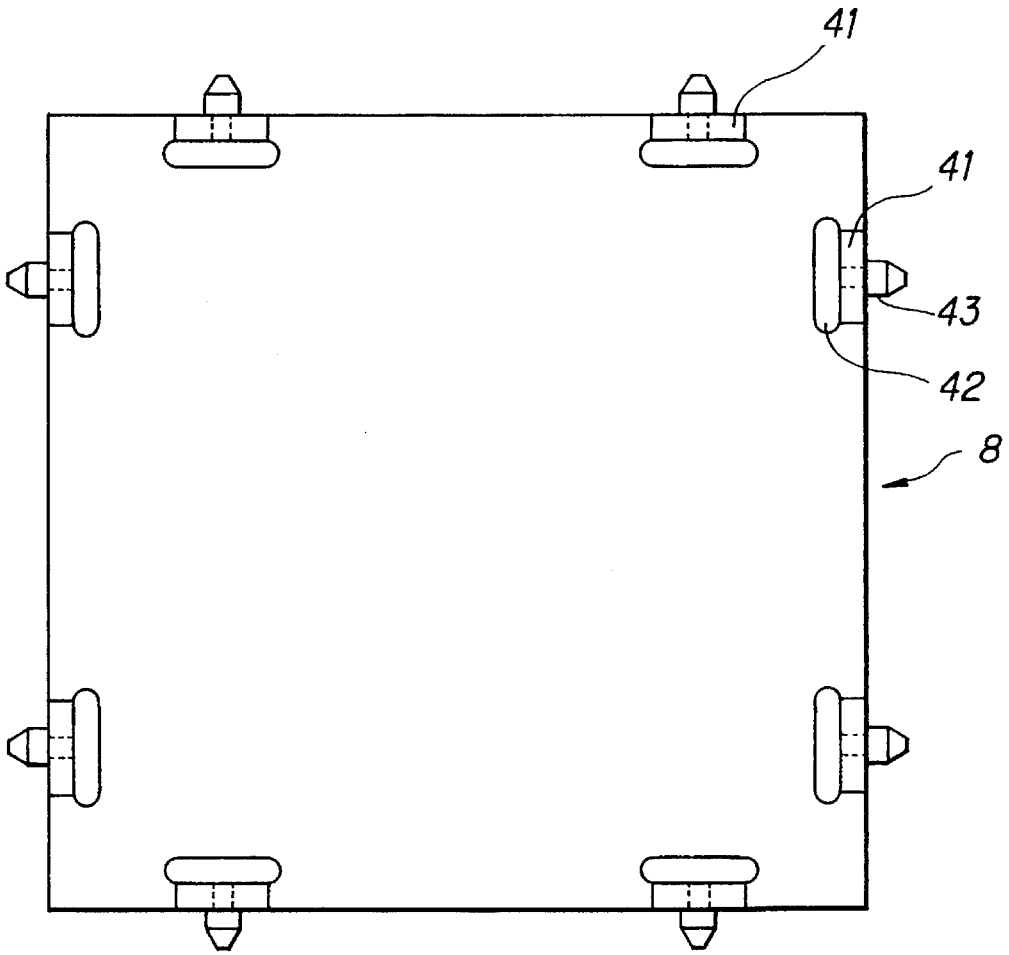
FIG. 5 is a plan view showing another example of the arrangement of a platen shown in FIG. 1.
Figure 6:
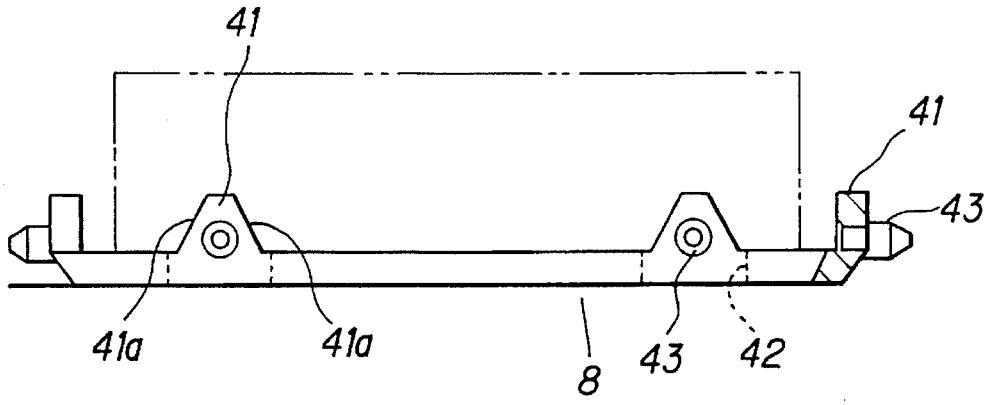

FIGS. 5 and 6 show another form of the platen 8. In this case, two ribs 41 are formed in each of the four sides of the plate 8. Slopes 41*a* having a slant angle of 20° to 70° with respect to the upper surface of the platen 8 are formed on the ribs 41. Also, oblong through-holes 42 are formed along an inside of each rib 41, and pins 43 are implanted in each rib 41.

Also according to this embodiment, it is possible to insure the same effect as that of the first embodiment.

It should be noted that the numbers of the ribs 41, through-holes 33 and 42 the pins 43 are not limited to those shown in each specific embodiments.

What is claimed is:

1. A powder beam etching machine comprising:

an injection chamber for etching a work laid on a support member by injecting powders to the work, said support member having at least one side which is sloped relative to a surface of said support member on which the work is laid;

a cleaning chamber for cleaning the work which has been etched, by air toward said support member in a direction substantially perpendicular to the surface thereof;

wherein the air is directed toward the at least one sloped side of said support member at an acute angle.

2. The etching machine according to claim 1, wherein said support member includes through-holes formed therein at corner portions of the surface of said support member.

3. A powder beam etching machine comprising:

an injection chamber for etching a work laid on a support member by injecting powders to the work, said support member having at least one side which is sloped relative to a surface of the support member on which the work is laid;

a cleaning chamber for cleaning the work which has been etched, by air toward said support member in a direction substantially perpendicular to the surface thereof;

wherein the air is directed toward the at least one sloped side of the support member at an acute angle;

wherein said acute angle is in the range of 20° to 70° relative to the surface of said support member.

* * * * *